US007195514B2

(12) United States Patent
Wakefield et al.

(10) Patent No.: US 7,195,514 B2
(45) Date of Patent: Mar. 27, 2007

(54) ELECTRICAL CONNECTORS WITH MULTI-POSITION, STRAIN RELIEF, CABLE CLAMP SYSTEMS AND METHODS THEREOF

(75) Inventors: Scott Wakefield, Andover, MA (US); William Chura, Medford, MA (US); Benjamin Hermance, Worcester, MA (US); Thomas Eagan, Chelmsford, MA (US); Chad Terry, Lunenburg, MA (US); John Aho, Lunenburg, MA (US)

(73) Assignee: Anderson Power Products, Sterling, MA (US)

( * ) Notice: Subject to any disclaimer, the term of this patent is extended or adjusted under 35 U.S.C. 154(b) by 0 days.

(21) Appl. No.: 11/227,890

(22) Filed: Sep. 15, 2005

(65) Prior Publication Data

US 2006/0089041 A1 Apr. 27, 2006

Related U.S. Application Data

(60) Provisional application No. 60/610,394, filed on Sep. 16, 2004.

(51) Int. Cl.
*H01R 13/58* (2006.01)

(52) U.S. Cl. ..... 439/465

(58) Field of Classification Search ..... 439/459, 439/460, 465, 466, 470, 473
See application file for complete search history.

(56) References Cited

U.S. PATENT DOCUMENTS 3,856,376 A * 12/1974 Poliak et al. ..... 439/465
4,108,527 A * 8/1978 Douty et al. ..... 439/465
4,422,706 A 12/1983 Neuhouser
4,630,876 A 12/1986 Grunberg et al.
4,722,580 A * 2/1988 Kocher et al. ..... 439/466
4,775,122 A * 10/1988 McClymont ..... 248/74.4
4,857,008 A 8/1989 Kee et al.
5,254,014 A 10/1993 Yagi et al.
5,588,870 A 12/1996 Boteler et al.
5,591,046 A 1/1997 Klein et al.
5,774,980 A * 7/1998 Klein et al. ..... 29/857
5,797,771 A 8/1998 Garside
6,071,145 A 6/2000 Toly
6,123,573 A * 9/2000 Savicki, Jr. ..... 439/469
6,179,646 B1 * 1/2001 Horchler ..... 439/460
6,193,543 B1 * 2/2001 Howard et al. ..... 439/459
6,431,887 B1 8/2002 Yeomans et al.
6,817,884 B1 11/2004 Chen et al.
6,991,487 B2 1/2006 Wu

OTHER PUBLICATIONS

PCT International Search Report dated Jul. 26, 2006 of International Application No. PCT/US05/33149 filed Sep. 16, 2005.

* cited by examiner

*Primary Examiner*—Gary Paumen
(74) *Attorney, Agent, or Firm*—Maine & Asmus

(57) ABSTRACT

An electrical connector system includes a connector housing with at least one conductive member disposed in at least one passage in the connector housing, two or more clamps which are detachably connected together to the connector housing about the passage, and at least one insert device detachably connected in a pocket in each of the clamps. The detachably connected clamps define at least one first opening to the passage in the connector housing and each of the insert devices extend from the pocket in each of the clamps into the first opening to define at least one second opening.

14 Claims, 7 Drawing Sheets

ELECTRICAL CONNECTORS WITH MULTI-POSITION, STRAIN RELIEF, CABLE CLAMP SYSTEMS AND METHODS THEREOF

This application claims the benefit of U.S. Provisional Patent Application Ser. No. 60/610,394, filed Sep. 16, 2004, which is herein incorporated by reference in its entirety.

FIELD OF THE INVENTION

This invention generally relates to electrical connectors and, more particularly, to electrical connectors with multi-position, strain relief, cable clamp systems and methods thereof.

BACKGROUND

A variety of different types of applications require electrical connectors to be connected and disconnected on a regular basis. During this use, the conductive cables which are coupled to these connectors are exposed to a substantial amount of stress and wear and tear. This stress is particularly high adjacent the connection point between the conductive cable and the electrical connector. If the connection point between the conductive cable and the electrical connector becomes loose or frayed, it can effect the performance of the system or device coupled to the electrical connector and can pose a safety hazard.

SUMMARY

An electrical connector system in accordance with embodiments of the present invention includes a connector housing with at least one conductive member disposed in at least one passage in the connector housing, two or more clamps which are detachably connected together to the connector housing about the passage, and at least one insert device detachably connected in a pocket in each of the clamps. The detachably connected clamps define at least one first opening to the passage in the connector housing and each of the insert devices extend from the pocket in each of the clamps into the first opening to define at least one second opening.

A method of making an electrical connector system in accordance with other embodiments of the present invention includes disposing at least one conductive member in at least one passage in a connector housing, detachable connecting at least one insert device in a pocket in each of two or more clamps, and detachably connecting two or more clamps together to the connector housing about the passage. The detachably connected clamps define at least one first opening to the passage in the connector housing and each of the insert devices extend from the pocket in each of the clamps into the first opening to define at least one second opening.

A strain relief, cable clamp system for an electrical connector in accordance with other embodiments of the present invention includes two or more clamps which are detachably connected together and define at least one first opening and at least one insert device detachably connected in a pocket in each of the clamps. Each of the insert devices extend from the pocket in each of the clamps into the first opening to define at least one second opening.

A method for making a strain relief, cable clamp system for an electrical connector in accordance with other embodiments of the present invention includes detachable connecting at least one insert device in a pocket in each of two or more clamps and detachable connecting the two or more clamps together to define at least one first opening. Each of the insert devices extend from the pocket in each of the clamps into the first opening to define at least one second opening.

The present invention provides a multi-position, strain relief, cable clamp systems for electrical connectors which can be easily assembled and adapted to a variety of different sizes of cables and types of electrical connectors, such as female and male single pole connectors, right angle connectors, and double pole connectors. With the present invention, the life of the electrical connector systems is extended because strain relief is provided at one of the highest regions of wear and tear. As a result, with the present invention there are fewer, if any, frayed or broken connections adjacent the electrical connector. The present invention also provides a secure connection between the strain relief, cable clamps and the electrical connector by altering at least a portion of the connecting structure to occupy more than one plane to provide a tighter fit when connected.

DETAILED DESCRIPTION

Figure 1:
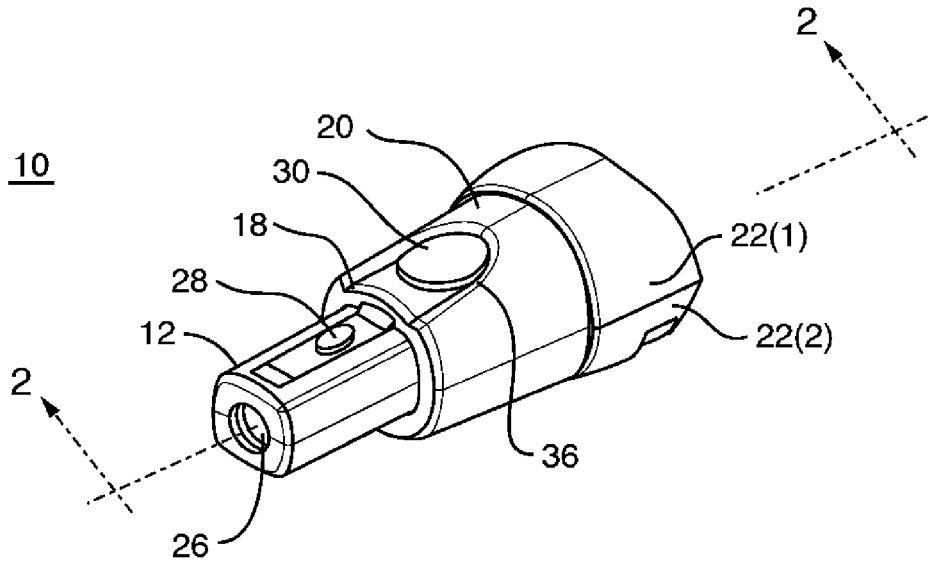
FIG. 1 is a perspective view of a female electrical connector with a multi-position, strain relief, cable clamp system in accordance with embodiments of the present invention.

An electrical connector 10 in accordance with embodiments of the present invention is illustrated in FIGS. 1–8F. The electrical connector 10 is a female connector with a connector housing 12, a conductive socket contact 14, a keeper 16, a latching assembly 18, a sleeve 20, strain relief clamp section 22(1) and 22(2), and insert devices 24(1)–24(2), although the connector 10 can have other numbers and types of components and elements in other configurations and other types of connectors, such as male connector, a double pole connector and a right angle connector. The present invention provides a number of advantages including providing a multi-position, strain relief, cable clamp systems for electrical connectors which can be easily assembled and adapted to a variety of different sized of cables and types of electrical connectors, such as female and male single pole connectors, right angle connectors, and double pole connectors.

Figure 2:
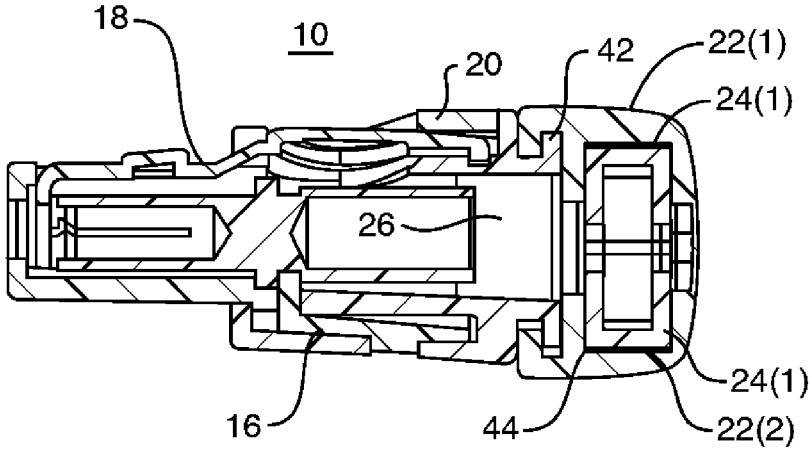
FIG. 2 is a cross-section view of the female electrical connector with the multi-position, strain relief, cable clamp system shown in FIG. 1 taken along lines 2—2.
Figure 3:
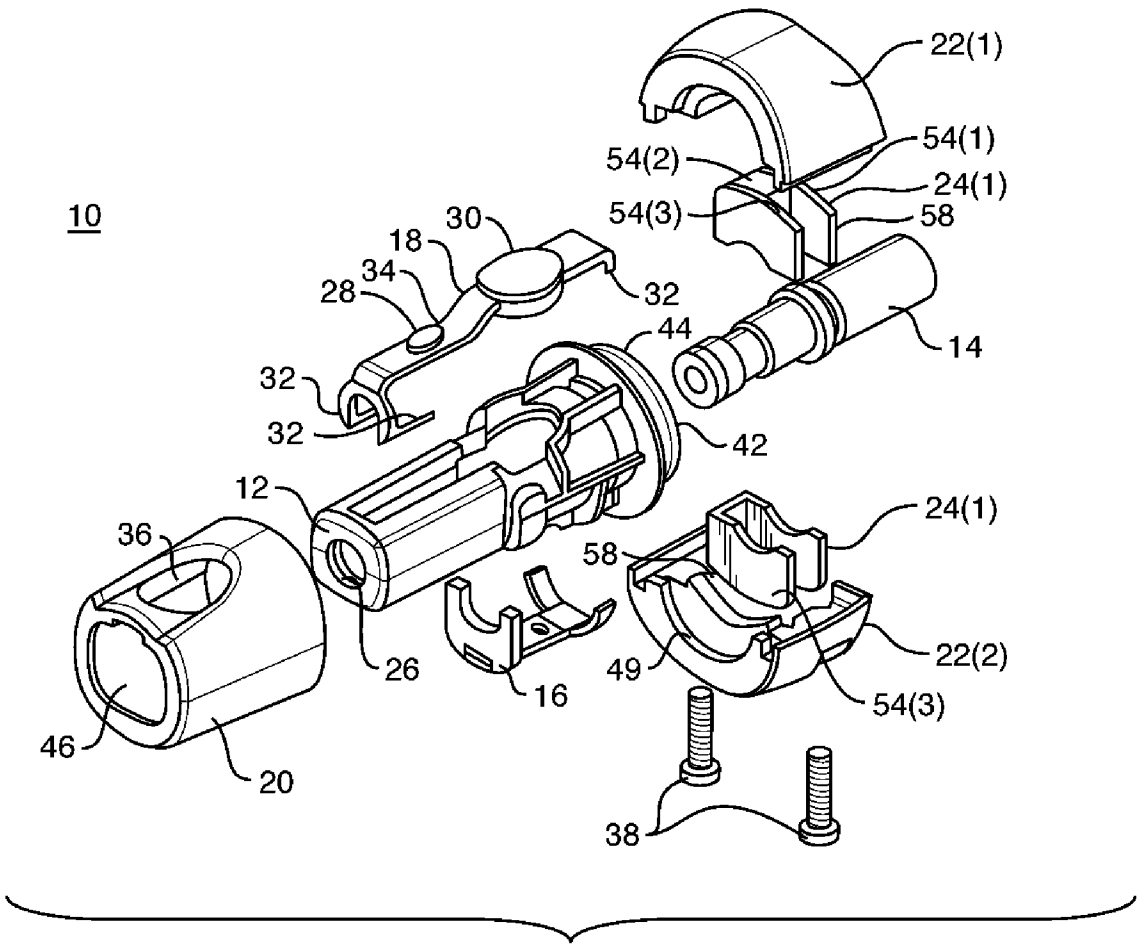
FIG. 3 is an exploded view of the female electrical connector multi-position, strain relief, cable clamp system shown in FIG. 1.
Figure 4:
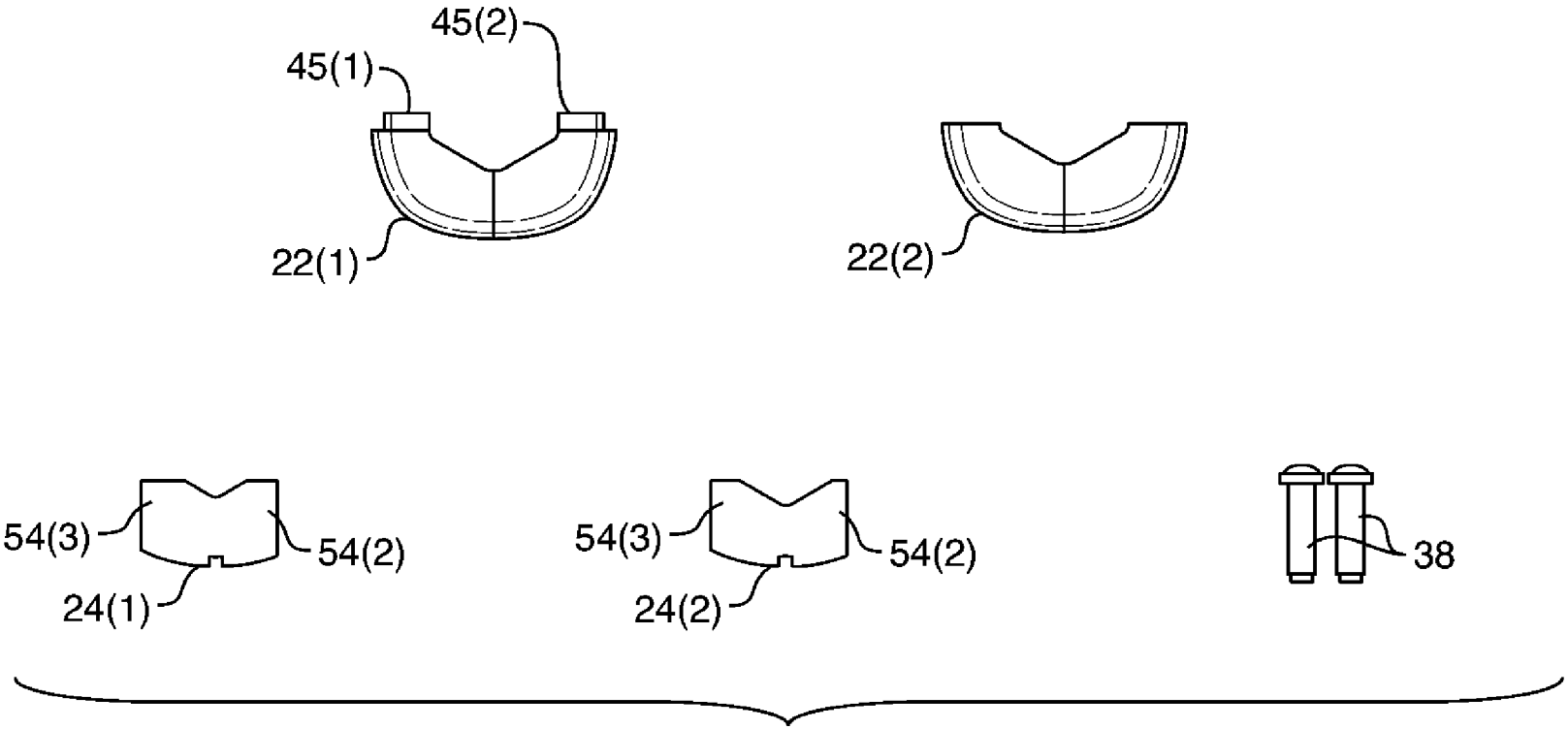
FIG. 4 is a side view of components of the multi-position, strain relief, cable clamp system in accordance with embodiments of the present invention.
Figure 5:
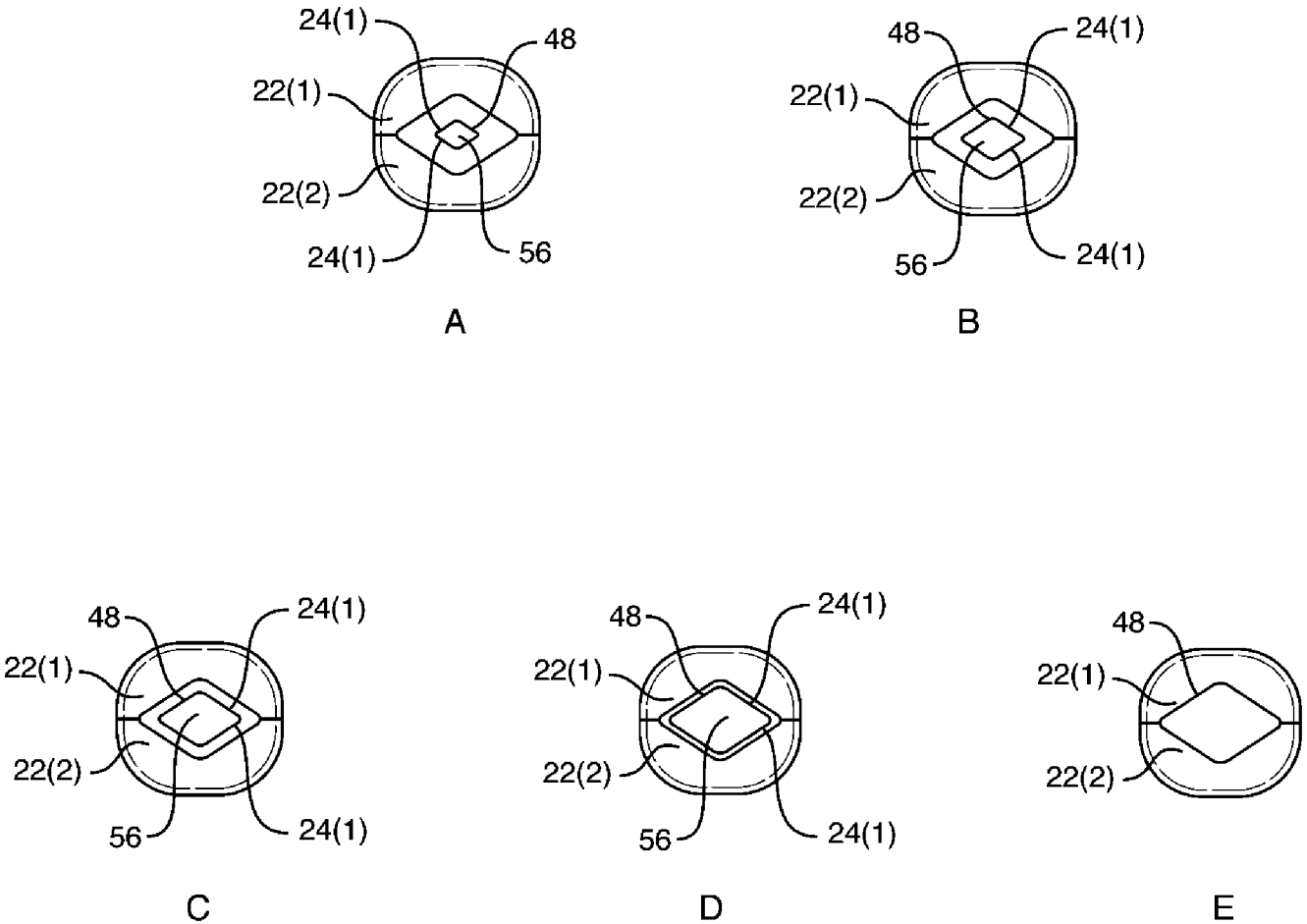
FIG. 5 is several back end views of electrical connectors with multi-position, strain relief, cable clamp systems.
Figure 6A:
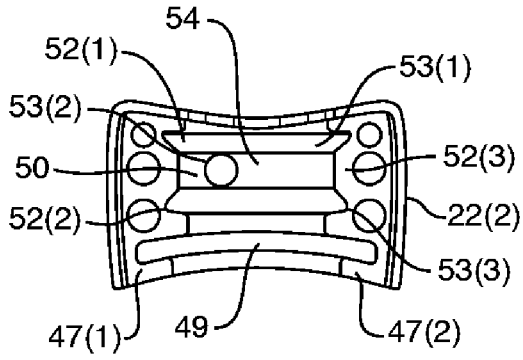
FIG. 6A is a top view of one strain relief clamp for multi-position, strain relief, cable clamp system.
Figure 6B:
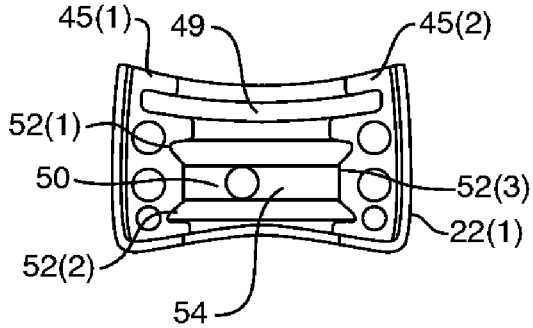
FIG. 6B is a top view of another strain relief clamp which mates with the strain relief clamp shown in FIG. 6A.
Figure 7:
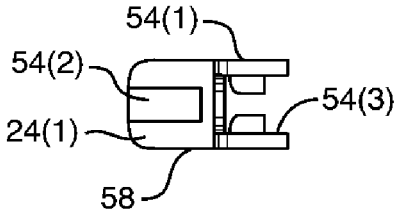
FIG. 7 is a top view of the an insert device for the multi-position, strain relief, cable clamp system.

Referring to FIGS. 1–3, the conductive socket contact 14 is seated in a passage 26 in the connector housing 12 and is secured in place by the keeper 16, although other numbers and types of conductive members, such as a male conductive pin, can be used, and the conductive members can be secured in or to the connector housing 12 in other manners. Additionally, the connector housing 12 can have other shapes and configurations, such as a right angle shaped connector housing or a double pole connector housing.

The latching assembly 18 includes a projection 28, an actuation member 30, legs 32, and a beam 34, although the latching assembly 18 can have other numbers and types of components and elements in other configurations, other types of detachable locking systems can be used, and the electrical connector may not have a latching assembly. The legs 32 of the latching assembly 18 are seated in the passage 26 and around the front end of the socket contact 14 and in the rear the legs 32 are secured to the connector housing 12, although the latching assembly 18 can have other numbers and types of legs and can be secured in other manners. The beam 34 of the latching assembly 18 extends along and is spaced from the connector housing 12 and the projection 28 and actuation member 30 extend away from the beam 34, although the other types and numbers of protrusion in other locations could be used. The projection 28 has an oval shape and is designed to detachably mate with an aperture in another connector, although the projection could have other shapes and sizes. The actuation member 30 can be used to disengage the projection 30 from the aperture.

The sleeve 20 has an opening 36 for the actuation member 30 and an opening 46 to the passage 26 in connector housing 12, although the sleeve 20 could have other shapes and configurations with other numbers of openings. The sleeve 20 is fitted over the connector housing 12 and the beam 34 of the latching assembly 18, although the sleeve 20 can be mounted in other manners.

Referring to FIGS. 2–3, 8C, and 8D, a flange 42 extends about an end 44 of the housing 12 and around the passage 26 to one end of the conductive socket contact 14, although the flange 42 could be in other locations and have other configurations, such as partially extending around the end 44 of housing 12 and comprising two or more pieces. The flange 42 has a "potato chip" shape with opposing portions 41 of the flange in a different plane from other opposing portions 43 of the flange 42, although the flange 42 could have other shapes with other types and numbers of elements in other numbers of planes. With the flange 42 having portions 41 and 43 in other planes, a tighter fit and better connection is made between the flange 42 in the connector housing 12 and grooves 49 in the strain relief clamp sections 22(1) and 22(2).

Referring to FIGS. 1–8F, the strain relief clamp sections 22(1) and 22(2) are secured together and about the flange 42 adjacent the end 44 of the housing 12 by screws 38, although other types and numbers of clamp sections and other types of clamping devices can be connected to end of the housing and the clamp sections can be secured in other manners. The strain relief clamp section 22(1) includes projections 45(1)–45(2) which are detachably mated in grooves 47(1)–47(2) in strain relief clamp section 22(2) when the strain relief clamp sections 22(1) and 22(2) are secured together, although the strain relief clamp sections 22(1) and 22(2) can be aligned and detachably mated together in other manners. The strain relief clamp sections 22(1) and 22(2) define an opening or passage 48 to one end of the conductive socket contact 14 in the passage 26 in the connector housing 12 which has a roughly diamond shape, although the opening 48 can have other shapes and sizes. Each of the strain relief clamp sections 22(1) and 22(2) includes a pocket 50 with rectangular-shaped, recessed portions 52(1)–52(3) and rectangular-shaped, non-recessed portions 53(1)–53(3) in an offset arrangement along a bottom surface 54, although each of the strain relief clamp sections 22(1) and 22(2) could have other numbers and types of recessed and non-recessed portions in other configurations.

One insert device 24(1) is sized and shaped to fit within the pocket 50 in each of the strain relief clamp sections 22(1) and 22(2). When the strain relief clamp sections 22(1) and 22(2) are detachably mated together, the insert devices 24(1) and 24(2) in the strain relief clamp sections 22(1) and 22(2) define another opening 56 which has a roughly diamond shape and which is in and is smaller than the opening 48, although the opening 56 defined by the devices 24(1) and 24(2) can have other shapes and sizes.

Figure 8A:
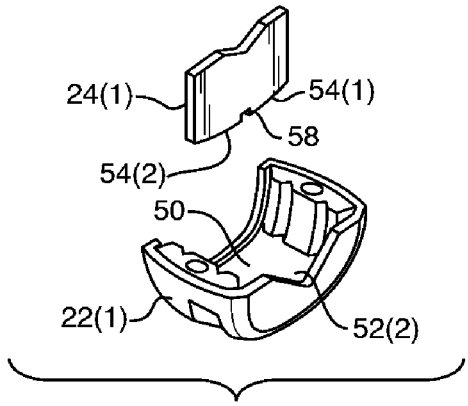
FIGS. 8A–8F are perspective views of a method for installing a multi-position, strain relief, cable clamp systems on an electrical connector.
Figure 8B:
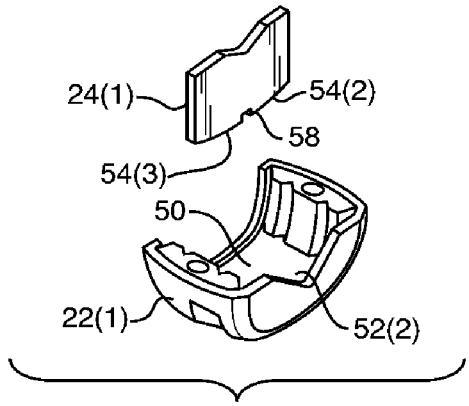

The insert device 24(1) in each of the strain relief clamp sections 22(1) and 22(2) has pads 54(1)–54(3) which extend out from a surface 58 of the insert device 24(1), although the insert device 24(1) could have other numbers and types of projections in other shapes and configurations. The pads 54(1)–54(3) are sized and shaped to mate with recessed portions 52(1)–52(3). When the pads 54(1)–54(3) of the insert device 24(1) are aligned with and mate with recessed portions 52(1)–52(3) in the strain relief clamp section 22(1) as shown in FIG. 8B, then the insert device 24(1) is seated deeper in the pocket 50 and the opening 56 is larger. When the pads 54(1)–54(3) of the insert device 24(1) are aligned with non-recessed portions 53(1)–53(3) in the strain relief clamp section 22(1) as shown in FIG. 8A, then the insert device 24(1) is seated shallower in the pocket 50 and the opening 56 is smaller. The insert device 24(1) can be aligned in the same manner in the strain relief clam section 22(2). Accordingly, based on the position of the insert device 24(1) in each of the strain relief clamp sections 22(1) and 22(2), the size and shape of the opening 56 can be adjusted to accept a different size conductive cable 60 which is coupled to the one end of the conductive socket contact 14.

Although the insert device 24(1) is disclosed in the examples described herein, other numbers and types of insert devices can be used, such as insert device 24(2). The insert device 24(2) is the same as the insert device 24(1), except the insert device 24(1) defines an initial opening with a width of about ⅜ of an inch and the insert device defines an initial opening sized and shaped to mate with sized and shaped to mate with a width of about ⅜ of an inch, although the insert devices 24(1) and 24(2) can have other dimensions.

A method of making an electrical connector system with a multi-position, strain relief, cable clamp system in accordance with embodiments of the present invention will now be described with reference to FIGS. 1–8F. A cable 60 is secured to one end of a conductive socket contact 14 in a passage 26 in a housing 12, although the cable 60 can be coupled to other types of conductive members. Next, the outside diameter of the cable 60, including the conductor and insulation for cable 60, is measured.

Once the measured diameter for the cable 60 is measured, then an insert device 24(1) or 24(2) for each of the strain relief cable clamp sections 22(1) and 22(2) can be selected. By way of example only, once the measured diameter for the cable 60 is obtained the type of insert device 24(1) or 24(2) and alignment for each insert device 24(1) or 24(2) in the each of the strain relief cable sections 22(1) and 22(2) can be determined from the table below:

Table of Suggested Insert Configuration based on Cable Diameters

| Cable OD (in) | Cable OD (mm) | Insert Needed | Depth | Max Opening | Picture Match |
|---|---|---|---|---|---|
| .27–.34 | 6.9–8.6 | ⅜ | Shallow | .19 [4.8] | A |
| .34–.41 | 8.6–10.4 | ⅜ | Deep | .25 [6.3] | B |
| .41–48 | 10.4–12.2 | ½ | Shallow | .33 [8.4] | C |
| .48–55 | 12.2–14.0 | ½ | Deep | .40 [10.2] | D |
| .55–.62 | 14.0–15.7 | NONE | N/A | .47 [11.9] | E |

Note:
the table above is to be used as a guideline for selecting inserts. The thickness and compressibility of the cable jacket will also affect insert selection.

In this example, the insert devices 24(1) and 24(2) and strain relief clamp sections 22(1) and 22(2) can provide five different sized openings for the cable 60 ranging from sizes A–E with the smallest at A and largest at E. Next, the selected insert devices 24(1) and/or 24(2) are lined up with the recessed portions 52(1)–52(3) and/or non-recessed portions 53(1)–53(3) in each of the strain relief cable clamp sections 22(1) and 22(2) as indicated in the table. Again, when the pads 54(1)–54(3) of the insert device 24(1) are aligned with and mate with recessed portions 52(1)–52(3) in the strain relief clamp section 22(1) as shown in FIG. 8B, then the insert device 24(1) is seated deeper in the pocket 50 and the opening 56 is larger. When the pads 54(1)–54(3) of the insert device 24(1) are aligned with non-recessed portions 53(1)–53(3) in the strain relief clamp section 22(1) as shown in FIG. 8A, then the insert device 24(1) is seated shallower in the pocket 50 and the opening 56 is smaller.

Figure 8C:
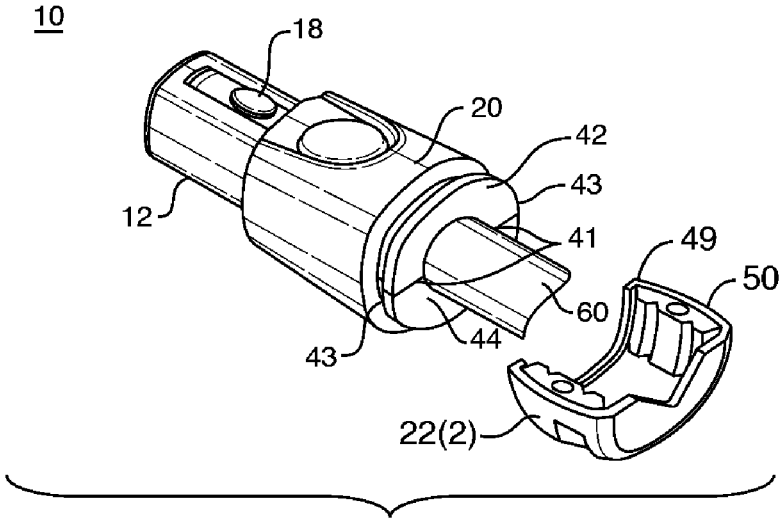
Figure 8D:
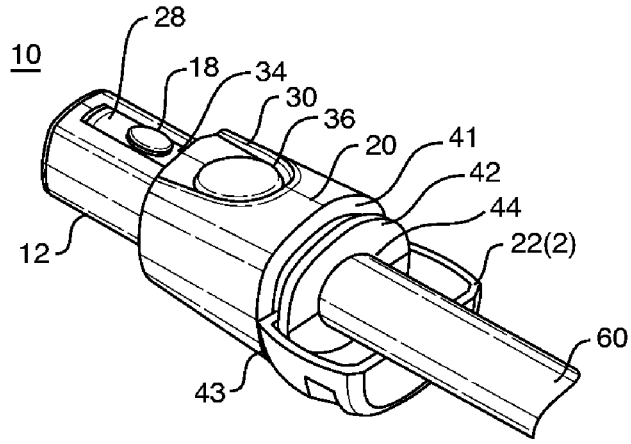

Once the insert device 24(1) or 24(2) is detachably secured in the pocket 50 in each of the strain relief clamp sections 22(1) and 22(2), groove 49 of strain relief clamp section 22(2) is detachably secured together around portions of the flange 42 adjacent the end 44 of the housing 12 as shown in FIGS. 8C and 8D, although other manners for securing the strain relief clamp section 22(1) and also strain relief clamp section 22(2) to the connector housing 12 can be used. With the flange 42 having portions 41 and 43 in other planes, a tighter fit and better connection is made between the flange 42 in the connector housing 12 and grooves 49 in the strain relief clamp section 22(2).

Figure 8E:
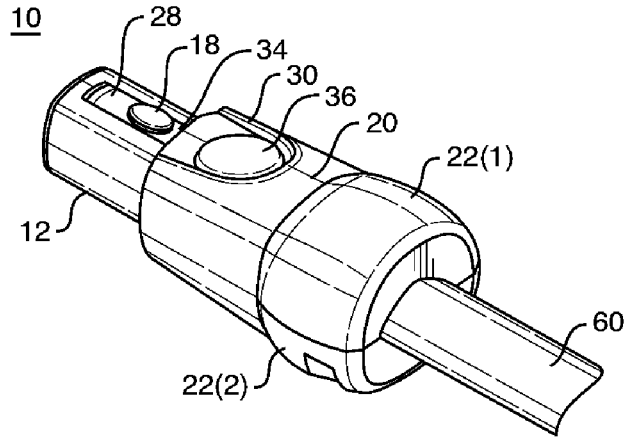
Figure 8F:
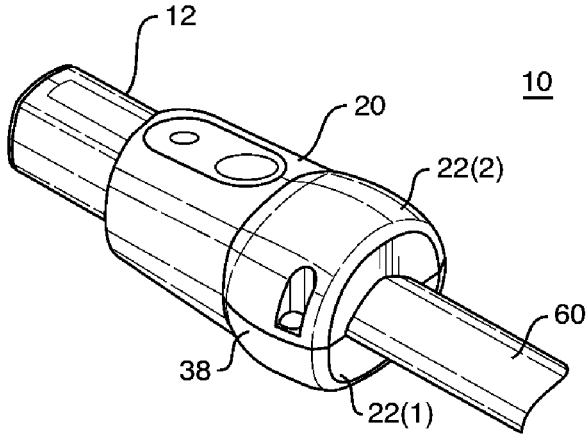

Next, the strain relief clamp section 22(1) is detachably mated to the strain relief clamp section 22(2) about the cable 60 with the projections 45(1)–45(2) which are detachably mated in grooves 47(1)–47(2) as shown in FIG. 8E, although other manners for mating the strain relief clamp sections 22(1) and 22(2) together about the cable 60 can be used. Additionally, the groove 49 of strain relief clamp section 22(1) is detachably secured together around other portions of the flange 42 adjacent the end 44 of the housing 12. Again, with the flange 42 having portions 41 and 43 in other planes, a tighter fit and better connection is made between the flange 42 in the connector housing 12 and grooves 49 in the strain relief clamp section 22(1). Next, the screws 38 are used to secured the strain relief clamp sections 22(1) and 22(2) together about the cable 60.

Accordingly, as described and illustrated herein the present invention provides a multi-position, strain relief, cable clamp systems which can be easily assembled and adapted to a variety of different sized of cables and types of electrical connectors, such as single pole connectors, right angle connectors, and double pole connectors. With the present invention, the life of the electrical connector systems is extended because strain relief is provided at one of the highest regions of wear and tear. As a result, with the present invention there are fewer, if any, frayed or broken connections adjacent the electrical connector. The present invention also provides a secure connection between the strain relief, cable clamps and the electrical connector by altering at least a portion of the connecting structure to occupy more than one plane to provide a tighter fit when connected.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed:

1. An electrical connector system comprising:

a connector housing with at least one conductive member disposed in at least one passage in the connector housing;

two or more clamps which are detachably connected together to the connector housing about the passage, wherein the detachably connected clamps define at least one first opening to the passage in the connector housing; and at least one insert device detachably connected in a pocket in each of the clamps, wherein each of the insert devices extend from the pocket in each of the clamps into the first opening to define at least one second opening, wherein at least one of the insert devices for each of the clamps has two or more detachable positions in the pocket in the clamp and each of the positions for the insert device provides a different size for the second opening, wherein each of the insert devices for each of the clamps has two or more positions in the pocket in the clamp and each of the positions for the insert device provides a different size for the second opening, and wherein the pocket in each of the clamps has at least one recessed section and the insert device has at least one projection that is sized and shaped to mate with the recessed section, wherein one of the positions of the insert device has the projection seated in the recessed section and another of the positions has the inserted device detachably connected in the pocket without the projection seated in the recessed section.

2. The system as set forth in claim 1 further comprising at least three of the recessed sections in the pocket in a spaced apart configurations and at least three of the projection which are sized, shaped, and configured to mate with the at least three recessed sections.

3. An electrical connector system comprising:

a connector housing with at least one conductive member disposed in at least one passage in the connector housing;

two or more clamps which are detachably connected together to the connector housing about the passage, wherein the detachably connected clamps define at least one first opening to the passage in the connector housing;

at least one insert device detachably connected in a pocket in each of the clamps, wherein each of the insert devices extend from the pocket in each of the clamps into the first opening to define at least one second opening, and at least one flange in the connector housing which extends at least partially around the passage; and at least one groove which extends along at least a portion of an inner surface of at least one of the clamps, wherein the flange is seated in the groove in each of the clamps when the two or more clamps are detachably connected together to the connector housing about the passage.

4. The system as set forth in claim 3 wherein one of the flange which extends at least partially around the passage and the groove which extends along at least a portion of an inner surface of at least one of the clamps has at least one portion which is in a different plane from another portion.

5. A method of making an electrical connector system, the method comprising:

disposing at least one conductive member in at least one passage in a connector housing;

detachably connecting at least one insert device in a pocket in each of two or more clamps; and detachably connecting two or more clamps together to the connector housing about the passage, wherein the detachably connected clamps define at least one first opening to the passage in the connector housing and each of the insert devices extend from the pocket in each of the clamps into the first opening to define at least one second opening, wherein at least one of the insert devices for each of the clamps has two or more detachable positions in the pocket in the clamp and each of the positions for the insert device provides a different size for the second opening, wherein each of the insert devices for each of the clamps has two or more positions in the pocket in the clamp and each of the positions for the insert device provides a different size for the second opening, and wherein the pocket in each of the clamps has at least one recessed section and the insert device has at least one projection that is sized and shaped to mate with the recessed section, wherein one of the positions of the insert device has the projection seated in the recessed section and another of the positions has the inserted device detachably connected in the pocket without the projection seated in the recessed section.

6. The method as set forth in claim 5 further comprising at least three of the recessed sections in the pocket in a spaced apart configurations and at least three of the projection which are sized, shaped, and configured to mate with the at least three recessed sections.

7. A method of making an electrical connector system, the method comprising:

disposing at least one conductive member in at least one passage in a connector housing;

detachably connecting at least one insert device in a pocket in each of two or more clamps; and detachably connecting two or more clamps together to the connector housing about the passage, and seating at least one flange in the connector housing which extends at least partially around the passage in at least one groove which extends along at least a portion of an inner surface of at least one of the clamps, wherein the detachably connected clamps define at least one first opening to the passage in the connector housing and each of the insert devices extend from the pocket in each of the clamps into the first opening to define at least one second opening.

8. The method as set forth in claim 7 wherein one of the flange which extends at least partially around the passage and the groove which extends along at least a portion of an inner surface of at least one of the clamps has at least one portion which is in a different plane from another portion.

9. A strain relief, cable clamp system for an electrical connector comprising:

two or more clamps detachably connected together so as to define at least one first opening; and at least one insert device detachably connected in a pocket in each of the clamps, wherein each of the insert devices extend from the pocket in each of the clamps into the first opening to define at least one second opening, wherein at least one of the insert devices for each of the clamps has two or more detachable positions in the pocket in the clamp and each of the positions for the insert device provides a different size for the second opening, wherein each of the insert devices for each of the clamps has two or more positions in the pocket in the clamp and each of the positions for the insert device provides a different size for the second opening, and wherein the pocket in each of the clamps has at least one recessed section and the insert device has at least one projection that is sized and shaped to mate with the recessed section, wherein one of the positions of the insert device has the projection seated in the recessed section and another of the positions has the inserted device detachably connected in the pocket without the projection seated in the recessed section.

10. The system as set forth in claim 9 further comprising at least three of the recessed sections in the pocket in a spaced apart configurations and at least three of the projection which are sized, shaped, and configured to mate with the at least three recessed sections.

11. A strain relief, cable clamp system for an electrical connector comprising:

two or more clamps which are detachably connected together and define at least one first opening;

at least one insert device detachably connected in a pocket in each of the clamps, wherein each of the insert devices extend from the pocket in each of the clamps into the first opening to define at least one second opening; and at least one groove formed along an inner surface in at least one of the clamps for mating with at least one projection on an electrical connector, wherein one of the groove which extends along at least a portion of an inner surface of at least one of the clamps is in a different plane from another portion.

12. A method for making a strain relief, cable clamp system for an electrical connector, the method comprising:

detachably connecting at least one insert device in a pocket in each of two or more clamps;

detachably connecting the two or more clamps together to define at least one first opening, wherein each of the insert devices extend from the pocket in each of the clamps into the first opening to define at least one second opening, wherein at least one of the insert devices for each of the clamps has two or more detachable positions in the pocket in the clamp and each of the positions for the insert device provides a different size for the second opening, wherein each of the insert devices for each of the clamps has two or more positions in the pocket in the clamp and each of the positions for the insert device provides a different size for the second opening, and wherein the pocket in each of the clamps has at least one recessed section and the insert device has at least one projection that is sized and shaped to mate with the recessed section, wherein one of the positions of the insert device has the projection seated in the recessed section and another of the positions has the inserted device detachably connected in the pocket without the projection seated in the recessed section.

13. The method as set forth in claim 12 further comprising at least three of the recessed sections in the pocket in a spaced apart configurations and at least three of the projection which are sized, shaped, and configured to mate with the at least three recessed sections.

14. A method for making a strain relief, cable clamp system for an electrical connector, the method comprising:

detachably connecting at least one insert device in a pocket in each of two or more clamps;

detachably connecting the two or more clamps together to define at least one first opening, wherein each of the insert devices extend from the pocket in each of the clamps into the first opening to define at least one second opening; and forming at least one groove along an inner surface in at least one of the clamps for mating with at least one projection on an electrical connector, wherein one of the groove which extends along at least a portion of an inner surface of at least one of the clamps is in a different plane from another portion.

* * * * *